US009216124B2

(12) United States Patent
Spendley

(10) Patent No.: US 9,216,124 B2
(45) Date of Patent: Dec. 22, 2015

(54) LEG SUPPORT FOR A SURGICAL TABLE

(71) Applicant: ESCHMANN HOLDINGS LIMITED, Lancing, West Sussex (GB)

(72) Inventor: Paul Roger Spendley, Hove (GB)

(73) Assignee: ESCHMANN HOLDINGS LIMITED, West Sussex (GB)

( * ) Notice: Subject to any disclaimer, the term of this patent is extended or adjusted under 35 U.S.C. 154(b) by 188 days.

(21) Appl. No.: 13/745,683

(22) Filed: Jan. 18, 2013

(65) Prior Publication Data

US 2013/0206149 A1 Aug. 15, 2013

(30) Foreign Application Priority Data

Jan. 20, 2012 (GB) ..... 1200979.1

(51) Int. Cl.

| | |
|---|---|
| ***A61G 15/00*** | (2006.01) |
| ***A61G 13/10*** | (2006.01) |
| ***A61G 13/08*** | (2006.01) |
| ***A61G 13/12*** | (2006.01) |

(52) U.S. Cl.

CPC ..... *A61G 13/10* (2013.01); *A61G 13/08* (2013.01); *A61G 13/1245* (2013.01); *A61G 13/1285* (2013.01); *A61G 13/126* (2013.01)

(58) Field of Classification Search

CPC ..... A61K 31/37; A61G 13/04; A61G 13/08; A61G 2013/0054; A61G 13/0036; A61G 13/06; A61G 7/008; A61G 13/02; A61G 7/001; A61G 2203/80; A61G 12/004; A61G 12/008; A61G 7/005; A61G 7/05; A61G 13/12; A61G 13/1245; A61G 13/125; A61G 13/1265; A61G 2013/0081

USPC ..... 128/845, 846, 870; 602/32

See application file for complete search history.

(56) References Cited

U.S. PATENT DOCUMENTS

| | | | | |
|---|---|---|---|---|
| 4,620,698 | A * | 11/1986 | Reed et al. | 5/651 |
| 6,202,230 | B1 | 3/2001 | Borders | 5/618 |
| 6,378,149 | B1 | 4/2002 | Sanders et al. | 5/624 |
| 2004/0133979 | A1 * | 7/2004 | Newkirk et al. | 5/600 |
| 2006/0042011 | A1 * | 3/2006 | Koch et al. | 5/624 |
| 2007/0116512 | A1 | 5/2007 | Katzenstein | 403/322.4 |

OTHER PUBLICATIONS

Search Report, Appl. No. GB 1200979.1, May 15, 2012.
Search Report, Appl. No. EP 13151510, Apr. 23, 2013.

* cited by examiner

*Primary Examiner* — Michael Brown
(74) *Attorney, Agent, or Firm* — Winston & Strawn LLP

(57) ABSTRACT

Described is a leg support for a surgical table, the leg support comprising a connector for connecting the leg support to a surgical table; an intermediate member mounted on the connector by a first pivot joint defining a first axis about which the intermediate member is displaceable relative to the connector; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support. Also described is a kit of parts for a leg support, a method of configuring a leg support, a surgical table comprising a leg support, and a kit of parts for a surgical table.

19 Claims, 12 Drawing Sheets

LEG SUPPORT FOR A SURGICAL TABLE

BACKGROUND

The present invention relates to a leg support for a surgical table, to a kit of parts for a leg support for a surgical table, to a method of configuring a leg support for a surgical table, to a surgical table comprising a leg support, and to a kit of parts for a surgical table. The leg support preferably is detachably connected or connectable to a surgical table.

Surgical tables comprising a base for standing on a floor, a column mounted on the base, and a tabletop mounted on the column and providing a patient support surface are well known. In one known surgical table, the tabletop is divided into multiple separate sections, the position of which relative to one another can be altered to vary the profile of the patient support surface, in order to best support a patient's body for surgery thereon or examination thereof. The separate sections comprise a head support, a torso support (comprised of an upper torso support and a lower torso support), and two leg supports. A lower end of the head support is mounted on an upper end of the upper torso support by means of a first pivot joint defining a transverse axis about which the head support can be displaced relative to the upper torso support. A lower end of the upper torso support is mounted on an upper end of the lower torso support by means of a second pivot joint defining a transverse axis about which the upper torso support can be displaced relative to the lower torso support. The leg supports are disposed beside each other in a transverse direction of the table, and respective upper ends of the leg supports are mounted on a lower end of the lower torso support. The leg supports are disconnectable and removable from the lower torso support to enable substitution of the two divided leg supports with a single leg support that is wider in the transverse direction and that preferably extends across the full width of the table.

The upper and lower torso supports share a common mattress that extends along the length of both torso supports in the longitudinal direction, and the common mattress is provided with a pair of spaced parallel grooves extending transversely across the width of the common mattress above and either side of the location of the second pivot joint between the upper and lower torso supports. The grooves permit flexing of the common mattress when the upper and lower torso supports are relatively inclined to each other by pivoting about the second pivot joint. The head support and the two leg supports each have a respective separate mattress.

A first one of the detachable leg supports has a support that supports the mattress, a connector for connecting the leg support to the lower torso support of the table, and an abduction joint that permits rotation of the support relative to the connector about an abduction axis, which is substantially perpendicular to the surface of the mattress. The leg support further has a lock that is operable to lock the support in one of a number of positions relative to the connector. The other of the detachable leg supports is similarly constructed, substantially as a mirror image to the first leg support. When the respective connectors of the two leg supports are each connected to the lower torso support, the connectors are fixed in position relative to the lower torso support and, by means of the respective abduction joints of the leg supports, the respective supports of the leg supports are rotatable about the respective abduction axes relative to the connectors and the lower torso support, in order to move apart from each other lower ends of the leg supports. The supports can then be locked in position relative to the connectors by operation of the locks.

When a patient is lying on the table with their legs on the respective leg supports, their legs are lifted and then, by means of the above-described arrangement, the position of the supports of the leg supports, relative to the connectors of the leg supports, are altered and the patient's legs are placed back down on the leg supports in a new position. As a result, the patient's legs may be supported by the supports in a position at which they are parallel or, alternatively, in a position at which they are spread apart from one another, i.e. abducted from the median plane of the rest of the patient's body, to enable a doctor or surgeon to access areas between the patient's legs. The leg supports can also be inclined using a hinged gas strut arrangement. This allows the patient's legs to be raised or lowered depending on the surgical procedure to be performed. Lowering the legs allows the patient to be positioned in the prone position for proctology or laminectomy type procedures, in which the patient is face down on the table with their legs bent behind them.

Surgery on obese patients is increasing. Gaining access to an obese patient's abdomen, for example to fit a gastric band or to carry out a bypass procedure, is particularly difficult when the patient is obese. Although the above-described known surgical table permits a patient's legs to be supported at a position at which they are spread apart from one another to aid access to their abdomen, there is a specific need for a surgical table, and a leg support therefor, that enables improved access to areas between a patient's legs.

Surgical tables and individual components thereof need periodically to be serviced and to be cleaned so as to remove any contamination therefrom. There is a still further need for a surgical table, and a leg support therefor, which enables improved access to areas between a patient's legs and which also is mechanically simple to aid servicing and cleaning.

As discussed above, it is advantageous for a leg support of a surgical table to be detachable from the table to enable substitution of the leg support with a different form of support. Often leg supports are removed from a surgical table, carried, and fitted to a surgical table by a member of hospital staff. There is a further need for a lightweight leg support for a surgical table which, when connected to the rest of the surgical table, enables improved access to areas between a patient's legs. The present invention avoids the disadvantages of the prior art.

SUMMARY OF THE INVENTION

A first aspect of the present invention provides a leg support for a surgical table, the leg support comprising: a connector for connecting the leg support to a surgical table; an intermediate member mounted on the connector by a first pivot joint defining a first axis about which the intermediate member is displaceable relative to the connector; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support.

Preferably, the intermediate member is displaceable relative to the connector only about the first axis. Preferably the support is displaceable relative to the intermediate member only about the second axis.

Preferably the support is displaceable relative to the connector only by one or both of displacement of the intermediate member relative to the connector about the first axis and displacement of the support relative to the intermediate member about the second axis.

The support may be displaceable relative to the intermediate member about the second axis between a position at which a body of the support abuts a body of the intermediate member and a position at which the body of the support does not abut the body of the intermediate member. Preferably the support is displaceable relative to the intermediate member about the second axis over an angle of at least 135 degrees, more preferably over an angle of at least 150 degrees, and most preferably over an angle of at least 165 degrees.

Optionally a plane normal to the first axis passes through both the intermediate member and the connector. Such a plane normal to the first axis may be coplanar with the plane normal to the second axis.

The intermediate member may be displaceable relative to the connector about the first axis between a position at which a body of the intermediate member abuts a body of the connector and a position at which the body of the intermediate member does not abut the body of the connector. Preferably the intermediate member is displaceable relative to the connector about the first axis over an angle of at least 135 degrees, more preferably over an angle of at least 150 degrees, and most preferably over an angle of at least 165 degrees.

The leg support may comprise a lock mechanism operable to fix one or both of the relative position of the intermediate member and the connector and the relative position of the support and the intermediate member. The lock mechanism may be operable through only a single action to fix both the relative position of the intermediate member and the connector and the relative position of the support and the intermediate member.

The support may comprise a resilient element upon which the leg of a patient is supportable. Such a resilient element may be detachably connected to the support.

Optionally the support comprises a body that has a first part mounted on the intermediate member by the second pivot joint and displaceable relative to the intermediate member about the second axis, and a second part that is mounted on the first part. The second part may be mounted on the first part by a third pivot joint defining a third axis about which the second part is displaceable relative to the first part. The third axis may be non-parallel to the second axis, such as perpendicular to the second axis. An angle between the second part and the first part may be controlled by one or more adjustable struts secured to and extending between the second part and the first part.

Preferably a distance between the first axis and the second axis is less than 20 cm, more preferably is less than 10 cm, more preferably is between 5 cm and 10 cm, more preferably is between 5 cm and 8 cm, and most preferably is about 6.5 mm.

The support may comprise a support element, which optionally is formed partially or wholly of radio translucent material. Such material may comprise one or more of a carbon fiber, reinforced polymer, polyoxybenzylmethylenglycolanhydride (or "Bakelite" (Registered Trademark) or filled phenolic resin).

The support element may have a width in a first direction perpendicular to the second axis and a length in a second direction that is perpendicular to the first direction, wherein the width and length of the support element together define an imaginary rectangular area. Preferably the imaginary rectangular area is not intersected by either of the first and second axes.

The support element may have a width in a first direction perpendicular to the second axis and a length in a second direction that is perpendicular to the first direction, wherein a distance between the first and second axes is less than the width of the support element. Preferably, a distance between the first and second axes is less than or equal to half the width of the support element. Most preferably, a distance between the first and second axes is less than or equal to a quarter of the width of the support element.

Preferably the width of the support element is between 20 and 35 cm. Preferably the length of the support element is between 40 and 80 cm.

Preferably the intermediate member excludes any resilient element upon which the leg of a patient is supportable.

The leg support may comprise an open chain consisting of, in order: the connector, the first pivot joint, the intermediate member, the second pivot joint, and the support. The open chain may have only two degrees of freedom. The open chain may be restricted to motion in only a single plane.

The support of the leg support may comprise a body that has a first part mounted on the intermediate member by the second pivot joint and displaceable relative to the intermediate member about the second axis, and a second part that is mounted on the first part by a third pivot joint defining a third axis about which the second part is displaceable relative to the first part In such a scenario, the leg support may comprise an open chain consisting of, in order: the connector, the first pivot joint, the intermediate member, the second pivot joint, the first part, the third pivot joint, and the second part. The open chain may have only three degrees of freedom. The open chain may be restricted to motion in only two planes.

A further aspect of the present invention provides a kit of parts for a leg support for a surgical table, the kit of parts comprising: a connector for connecting the leg support to a surgical table; an intermediate member mountable on the connector by a first pivot joint defining a first axis about which the intermediate member is displaceable relative to the connector; and a support for supporting a leg of a patient, the support mountable on the intermediate member by a second pivot joint defining a second axis about which the support is displaceable relative to the intermediate member independently of displacement of the intermediate member relative to the connector about the first axis, the second axis being parallel to the first axis, wherein the support is mountable on the intermediate member by the second pivot joint such that a plane normal to the second axis passes through both the intermediate member and the support.

A further aspect of the present invention provides a method of configuring a leg support for a surgical table, the leg support comprising a connector for connecting the leg support to a surgical table; an intermediate member mounted on the connector by a first pivot joint defining a first axis about which the intermediate member is displaceable relative to the connector; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support; the method comprising one or both of: displacing the intermediate member about the first axis relative to the connector; and displacing the support about the second axis relative to the intermediate member. Optionally the method comprises connecting the leg support to the surgical table by means of the connector prior to the, or both, displacing step(s).

A further aspect of the present invention provides a surgical table comprising a leg support according to the first aspect of the present invention.

A further aspect of the present invention provides a surgical table comprising a tabletop providing a patient support surface, the tabletop having a head support, a torso support and a leg support section arranged respectively in that order along a longitudinal direction of the tabletop between upper and lower ends of the tabletop, the leg support section having a leg support comprising: a connector by which the leg support is connected to the torso support; an intermediate member mounted on the connector by a first pivot joint defining a first axis about which the intermediate member is displaceable relative to the connector; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support.

The leg support section preferably comprises a pair of leg supports disposed beside each other in a transverse direction of the table. The, or each, leg support may be detachably connected to the torso support.

A further aspect of the present invention provides a kit of parts for a surgical table, the kit of parts comprising: a tabletop providing a patient support surface, the tabletop having a head support and a torso support arranged respectively in that order along a longitudinal direction of the tabletop between upper and lower ends of the tabletop; and a leg support comprising: a connector by which the leg support is connectable to the torso support; an intermediate member mounted on the connector by a first pivot joint defining a first axis about which the intermediate member is displaceable relative to the connector; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
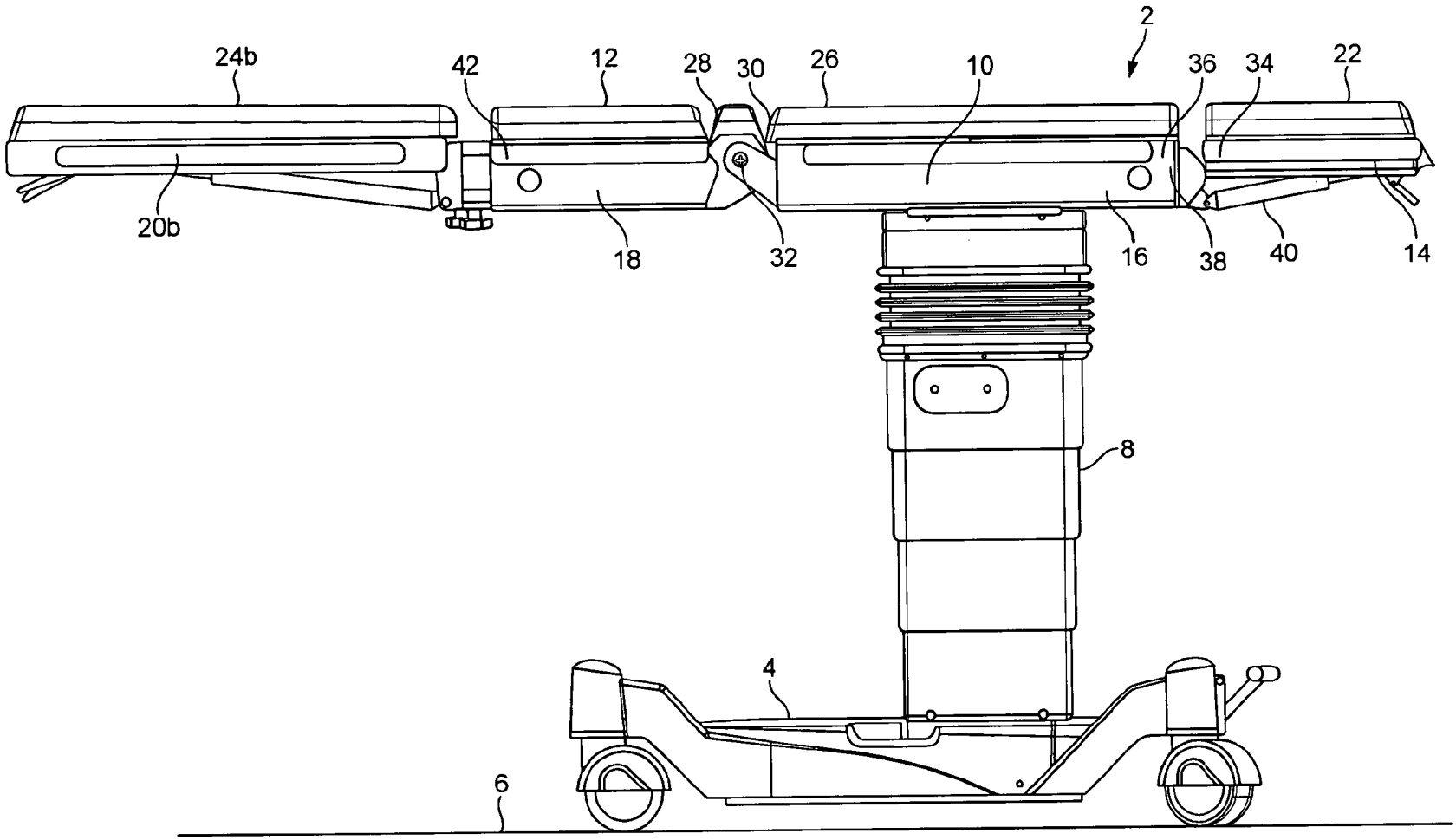
FIG. 1 is a schematic side view of a surgical table comprising an embodiment of the present invention.
Figure 2A:
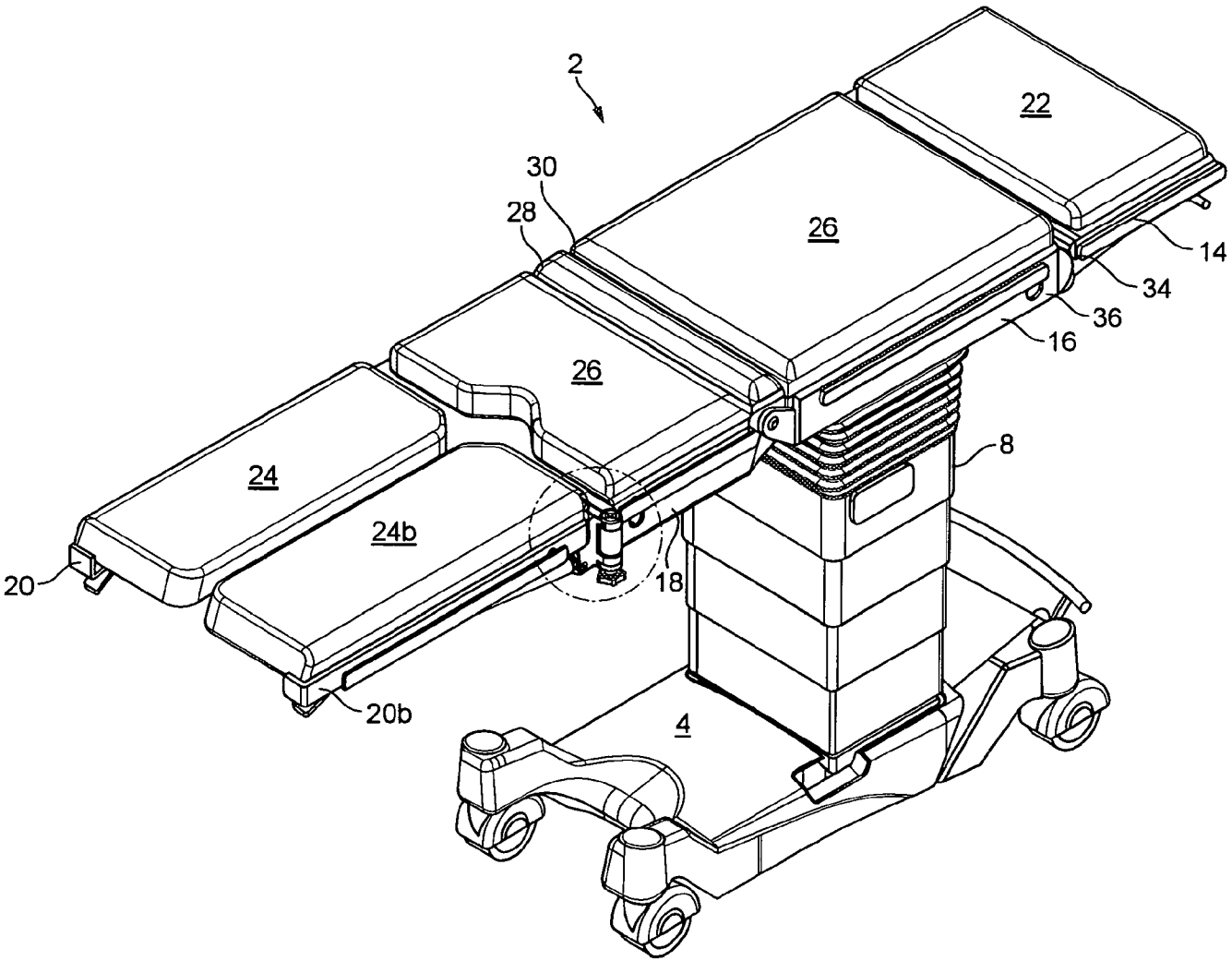
FIG. 2*a* is a schematic perspective view of the surgical table of FIG. 1.
Figure 3A:
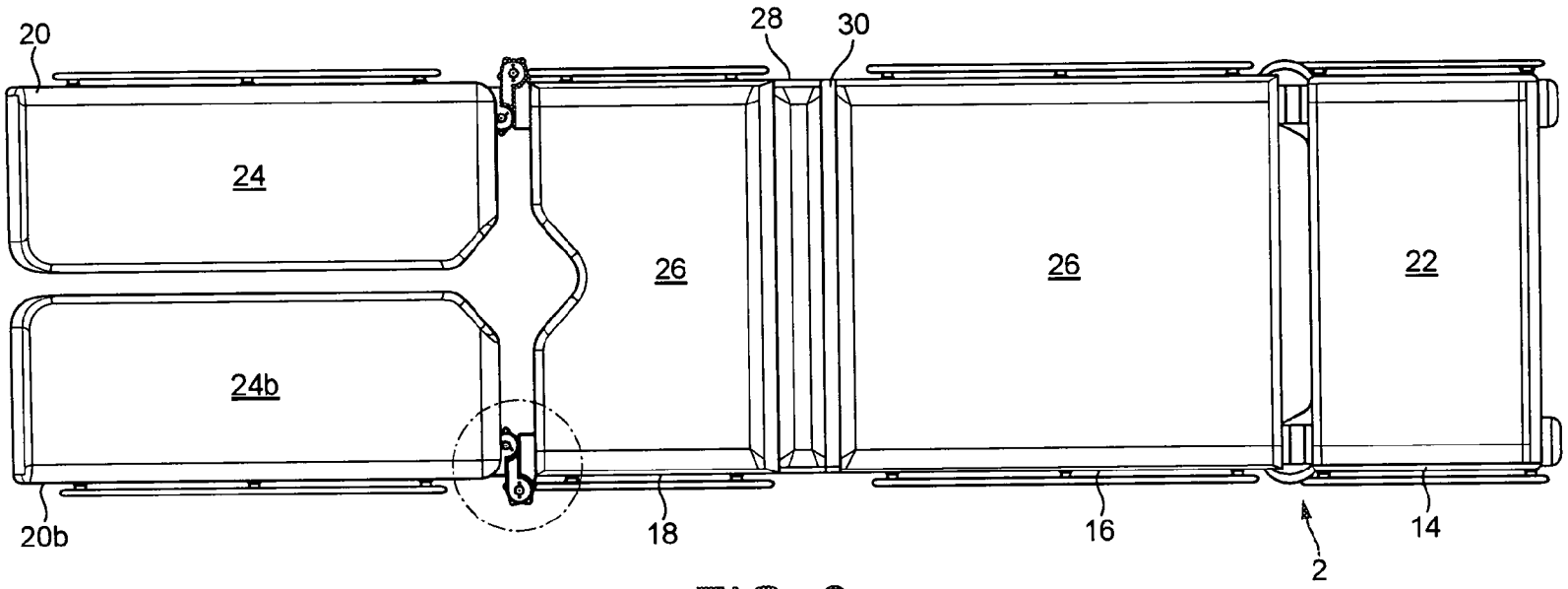
FIG. 3*a* is a schematic plan view of the surgical table of FIG. 1.

Referring to FIGS. 1, 2*a* and 3*a*, the surgical table, designated generally as 2, of one embodiment of the present invention comprises a base 4, which stands on the floor 6, a column 8 of adjustable height mounted on the base 4 and a tabletop 10 providing a patient support surface 12. In other embodiments, the column 8 is not of adjustable height.

The tabletop 10 is divided into three sections, namely a head support 14, a torso support (comprising an upper torso support 16 and a lower torso support 18) and a leg support section (comprising a pair of leg supports 20, 20*b*) arranged respectively in that order along a longitudinal direction of the tabletop between upper and lower ends of the tabletop. The leg supports 20, 20*b* are disposed beside each other in a transverse direction of the table. The head and leg supports 14, 20, 20*b* each have their own respective separate mattress 22, 24, 24*b*. The upper and lower torso supports 16, 18 have a common mattress 26 extending along the length of both supports 16, 18. The common mattress 26 is provided with a pair of spaced parallel grooves 28, 30 extending transversely across the width of the tabletop 10 above the location of a pivot joint 32 between the upper and lower torso supports 16, 18. This permits flexing of the common mattress 26 when the upper and lower torso supports 16, 18 are relatively inclined to each other by pivoting about a transverse axis defined by the pivot joint 32. The mattresses 22, 24, 24*b*, 26 are detachable from the table 2 for cleaning, repair or replacement of the mattresses 22, 24, 24*b*, 26 and for cleaning or servicing of the rest of the table 2.

The mattresses 22, 24, 24*b*, 26 each sit on top of a respective detachable cover (not shown), which preferably is made of an ABS polymer. In each leg support 20, 20*b*, the cover fits over the support element 420 and second part 406 of the support body 402, which are described below. The cover provides a smooth surface that may easy be wiped for cleaning purposes, specifically to remove fluids used or encountered during surgical procedures. In each leg support 20, 20*b*, retainers, such as screws or pegs, for detachably retaining the mattresses 24, 24*b* on the leg support 20, 20*b*, are fixed through the cover.

On the side of each leg support 20, 20*b* is provided a respective sidebar or rail, to which conveniently may be affixed various accessories used during surgical procedures or examinations. In each leg support 20, 20*b*, the sidebar is fixed to the support body 402 (and specifically to the second part 406 of the support body 402) through the cover.

A lower end 34 of the head support 14 is mounted on an upper end 36 of the upper torso support 16 by means of a second pivot joint 38 defining a transverse axis about which the head support 14 can be displaced relative to the upper torso support 16. The angle of inclination of the head support 14 is controlled by means of a pair of conventional adjustable struts 40, only one of which is shown in FIG. 1, secured to and extending between the underside of the head support 14 and the upper torso support 16, one on each side of the tabletop 10. The struts 40 may be hydraulic or electric actuators or lockable gas springs. The leg supports 20 are mounted at a lower end 42 of the lower torso support 18 and are detachable from the lower torso support 18, as will be described in more detail below.

The provision of the pivot joints 32, 38 permits the head, upper and lower torso supports 14, 16, 18 selectively to be inclined relative to adjacent supports 14, 16, 18 thereby to dispose the tabletop 10 in a selected configuration.

Optionally, a further pivot joint (not shown) is provided between a first part of the lower torso support 18 (to which the leg supports 20, 20*b* detachably connected) and a second part of the lower torso support 18. The further pivot joint would define a transverse axis about which the leg support(s) 20, 20*b* can be displaced relative to the second part of the lower torso support 18. The provision of this further pivot joint permits the whole of either or both leg supports 20, 20*b* selectively to be inclined relative to the lower torso support 18, thereby further increasing the number of permutations of the various supports 14, 16, 18, 20, 20*b* relative to one another, which in turn increases the versatility of the tabletop 10 for different procedures.

Figure 4:
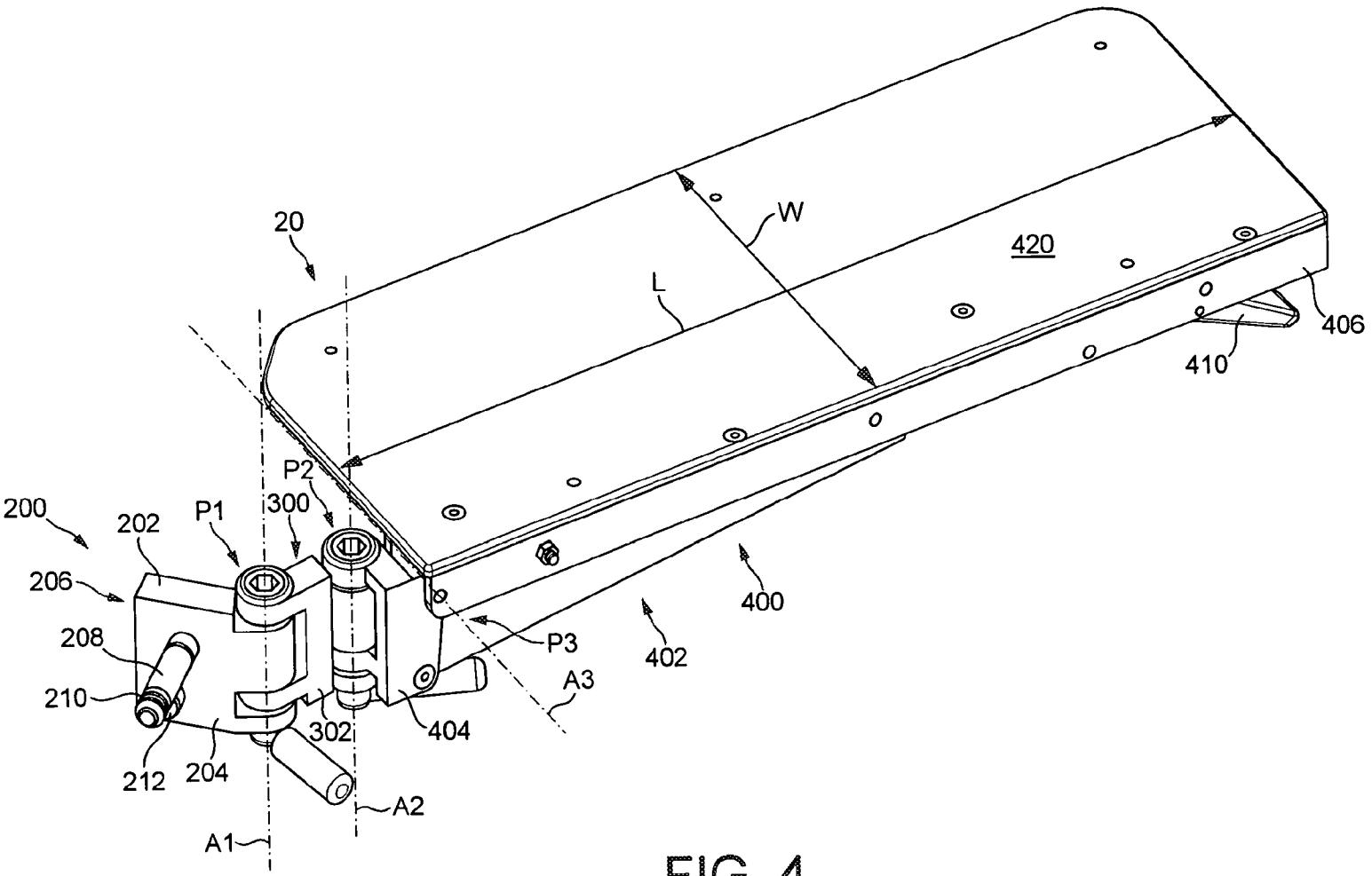
FIG. 4 is a schematic perspective view of a leg support for the surgical table of FIG. 1, shown disconnected from the surgical table and with its cover, sidebar and mattress omitted for clarity, which leg support comprises an embodiment of the present invention.

The leg supports 20, 20*b* of the table 2 will now be described in more detail, with reference to FIGS. 4 and 5. Although only one of the leg supports 20 is illustrated in FIG. 4, the other of the leg supports 20*b* has corresponding features to those discussed herein for the one of the leg supports 20, albeit in a mirror-image arrangement. In FIG. 4 the leg support 20 is shown with its mattress 24, cover and sidebar removed, and in FIG. 5 the components (excluding the mattress 24, cover and sidebar) of the leg support 20 are shown in exploded form.

The leg support 20 comprises a connector 200 for connecting the leg support 20 to the lower torso support 18 of the surgical table 2 of FIG. 1. The connector 200 comprises a rigid body 202 with a face 204 which, when the leg support 20 is mounted on the table 2, abuts a face of the lower torso support 18 and is disposed in a plane that is parallel to a plane in which the face of the frame of the lower torso support 18 lies. The connector 200 has a lock projection 206, which extends from the face 204 and comprises a tubular member 208 of circular cross section that has a proximal end attached to the face 204, a distal end remote from the face 204, and a longitudinal axis that is normal to the face 204. The tubular member 208 has a groove 210 formed in its circumferential surface at a point along its longitudinal axis between its proximal and distal ends. The groove 210 extends fully around the circumference of the tubular member 208, although in other embodiments the groove 210 extends only part way around the circumference of the tubular member 208. The connector 200 further has an anti-rotation projection 212, which extends from the face 204 and is spaced from the lock projection 206. As illustrated in FIG. 5, each of the lock projection 206 and the anti-rotation projection 212 is fixed to the body 202 relative to the face 204 by means of a respective screw 206*a*, 212*a*, although in other embodiments one or both of the lock projection 206 and the anti-rotation projection 212 may be integrally formed with the body 202.

When the connector 200 is connected to the rest of the surgical table 2, the anti-rotation projection 212 and the lock projection 206 respectively are received in a corresponding recess and hole in the face of the lower torso support 18 and then a locking element of the lower torso support 18, which locking element may be biased to a position at which it interferes with insertion of the lock projection 206 into the hole, locates in the groove 210 to prevent subsequent withdrawal of the lock projection 206 from the hole. The cooperation of the anti-rotation projection 212 and the recess prevents rotation of the body 202 relative to the lower torso support 18 about the longitudinal axis of the tubular member 208. The leg support 20 connected to the lower torso support 18 is shown in each of FIGS. 1 to 3*b*. The locking element is removable from the groove 210, such as by operation of a lever or button on the surgical table 2, to permit withdrawal of the lock projection 206 from the hole and thus to permit disconnection of the leg support 20 from the table 2.

The leg support 20 further comprises an intermediate member 300 comprising a rigid body 302. The intermediate member 300 is mounted on the connector 200 by a first pivot joint P1 defining a first axis A1 about which the intermediate member 300 is displaceable relative to the connector 200. That is, the intermediate member 300 is connected to the connector 200 only via the first pivot joint P1. The intermediate member 300 is displaceable relative to the connector 200 only about the first axis A1. That is, the intermediate member 300 is prevented from translation relative to the connector 200, and is prevented from displacement relative to the connector 200 about any other axis, whether parallel or non-parallel, such as perpendicular, to the first axis A1.

The first pivot joint P1 comprises a hinge having a first pivot pin 502 and a barrel 214 of the connector 200 rotatably mounted on the first pivot pin 502. The barrel 214 of the connector 200 is integrally formed with the body 202 of the connector 200 and is rotatable relative to the first pivot pin 502 about the first axis A1 at a first position on the first axis A1. Similarly, a barrel 304 of the intermediate member 300 is integrally formed with the body 302 of the intermediate member 300 and is rotationally fixed relative to the first pivot pin 502 about the first axis A1 at a second position on the first axis A1. The second position is axially spaced from the first position on the first axis A1, such that the barrels 214, 304 are spaced along the first pivot pin 502 in the direction of the first axis A1.

Figure 2B:
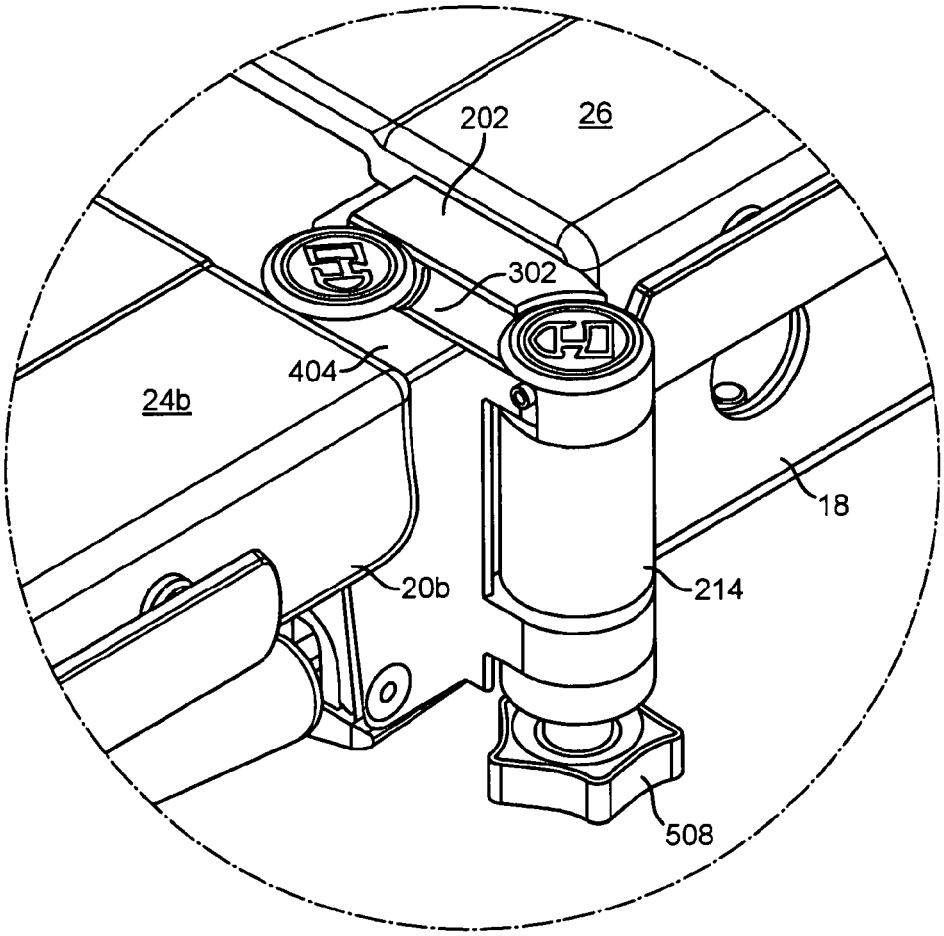
FIG. 2*b* is an enlarged schematic view of part of the surgical table of FIG. 2*a;*
Figure 3B:
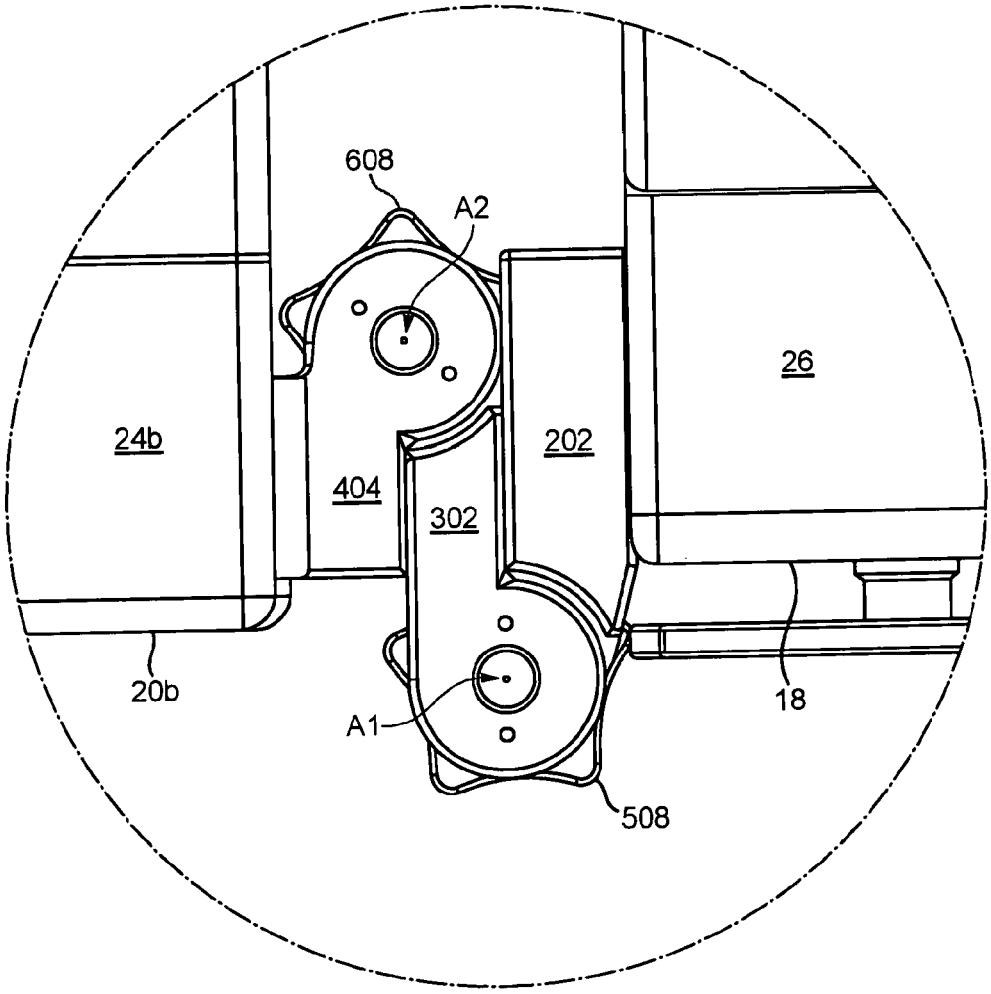
FIG. 3*b* is an enlarged schematic view of part of the surgical table of FIG. 3*a;*

A first virtual plane normal to the first axis A1 passes through both the intermediate member 300 and the connector 200. That is, the body 302 of the intermediate member 300 and the body 202 of the connector 200 lie in a common plane that is normal to the first axis A1. Accordingly, the first pivot joint P1 permits displacement of the intermediate member 300 relative to the connector 200 about the first axis A1 only over an angle of less than 360 degrees. In this embodiment, the intermediate member 300 is displaceable relative to the connector 200 about the first axis A1 between a position at which the bodies 202, 302 of the connector 200 and the intermediate member 300 abut each other, as shown in FIGS. 2*b*, 3*b*, 6 and 8*a* (although FIGS. 2*b* and 3*b* show the other leg support 20*b*, it will be appreciated that leg support 20 is of the same configuration, albeit as a mirror-image), and a position at which the bodies 202, 302 do not abut, as shown in FIGS. 7 and 8*d*. As will be appreciated by comparison of FIGS. 8*a* and 8*d*, in this embodiment the intermediate member 300 is displaceable relative to the connector 200 about the first axis A1 over an angle of approximately 165 degrees. In other embodiments, the angle may be at least 180 degrees, but in any case the angle is preferably at least 90 degrees, more preferably at least 135 degrees, more preferably at least 150 degrees, and most preferably at least 165 degrees.

The leg support 20 further comprises a support 400 comprising a body 402. The body 402 comprises a first part 404 and a second part 406, each of which, respectively, is rigid. The support 400, i.e. the support 400 taken as a whole, is mounted on the intermediate member 300 by a second pivot joint P2 defining a second axis A2 about which the support 400 is displaceable relative to the intermediate member 300. More particularly, the first part 404 of the body 402 is mounted on the intermediate member 300 by the second pivot joint P2 and is displaceable relative to the intermediate member 300 about the second axis A2. That is, the support 400 (and more particularly the first part 404) is connected to the intermediate member 300 only via the second pivot joint P2. The second axis A2 is parallel to the first axis A1. The support 400 (and more particularly the first part 404) is displaceable relative to the intermediate member 300 only about the second axis A2. That is, the support 400 is prevented from translation relative to the intermediate member 300, and is prevented from displacement relative to the intermediate member 300 about any other axis, whether parallel or non-parallel, such as perpendicular, to the second axis A2.

The support 400 is displaceable relative to the intermediate member 300 about the second axis A2 independently of displacement of the intermediate member 300 relative to the connector 200 about the first axis A1. That is, relative displacement of the intermediate member 300 and the connector 200 does not cause relative displacement of the support 400 and the intermediate member 300. As such, it will be appreciated that the support 400 is displaceable relative to the connector 200 only by one or both of displacement of the intermediate member 300 relative to the connector 200 about the first axis A1, and displacement of the support 400 relative to the intermediate member 300 about the second axis A2.

The intermediate member 300 is rigid. That is, no portion of the member 300 is displaceable relative to another portion of the member 300. Preferably the intermediate member 300 consists of only one component, which comprises the body 302. The member 300 excludes any four bar linkage or other means for varying the relative positions of the first axis A1 and the second axis A2. That is, the first axis A1 is fixed as parallel to the second axis A2, and a distance between the first axis A1 and the second axis A2, in a direction normal to both of the first axis A1 and the second axis A2, is fixed. In this embodiment, this distance is about 6.5 cm. This distance preferably is less than 20 cm, more preferably is less than 10 cm, more preferably is between 5 cm and 10 cm, and most preferably is between 5 cm and 8 cm.

The second pivot joint P2 comprises a hinge having a second pivot pin 602 and a barrel 306 of the intermediate member 300 rotatably mounted on the second pivot pin 602. The barrel 306 of the intermediate member 300 is integrally formed with the body 302 of the intermediate member 300 and is rotatable relative to the second pivot pin 602 about the second axis A2 at a first position on the second axis A2. Similarly, a barrel 408 of the support 400 is integrally formed with the body 402 (and more particularly with the first part 404 of the body 402) of the support 400 and is rotationally fixed relative to the second pivot pin 602 about the second axis A2 at a second position on the second axis A2. The second position is axially spaced from the first position on the second axis A2, such that the barrels 306, 408 are spaced along the second pivot pin 602 in the direction of the second axis A2.

A second virtual plane normal to the second axis A2 passes through both the intermediate member 300 and the support 400. That is, the body 302 of the intermediate member 300 and the body 402 of the support 400 lie in a common plane that is normal to the second axis A2. Accordingly, the second pivot joint P2 permits displacement of the support 400 relative to the intermediate member 300 about the second axis A2 only over an angle of less than 360 degrees. In this embodiment, the support 400 is displaceable relative to the intermediate member 300 about the second axis A2 between a position at which the bodies 302, 402 of the intermediate member 300 and the support 400 abut each other, as shown in FIGS. 2*b*, 3*b*, 6 and 8*a*, and a position at which the bodies 302, 402 do not abut, as shown in FIGS. 7 and 8*d*. As will be appreciated by comparison of FIGS. 8*a* and 8*d*, in this embodiment the support 400 is displaceable relative to the intermediate member 300 about the second axis A2 over an angle of approximately 165 degrees. In other embodiments, the angle may be at least 180 degrees, but in any case the angle is preferably at least 90 degrees, more preferably at least 135 degrees, more preferably at least 150 degrees, and most preferably at least 165 degrees.

Although other embodiments may vary, in the present embodiment a virtual plane normal to both the first and second axes A1, A2 passes through all of the connector 200, the intermediate member 300, and the support 400. That is, the first virtual plane is coplanar with the second virtual plane.

The combination of the first and second pivot joints P1, P2 and the intermediate member 300 are considered to comprise an articulated joint between the connector 200 and the support 400.

A first end of the second part 406 of the body 402 of the support 400 is mounted on the first part 404 of the body 402 by a third pivot joint P3 defining a third axis A3 about which the second part 406 is displaceable relative to the first part 404. The third axis A3 is perpendicular to the second axis A2 in this embodiment, although in other embodiments it may not be perpendicular. It is preferable that the third axis A3 be non-parallel to the second axis A2. A second, distal end of the second part 406 is a free end of the support 400 and of the leg support 20.

Secured to and extending between the first and second parts 404, 406 is an actuator or strut 418 of adjustable length, such as one of a hydraulic actuator, an electric actuator and a lockable gas spring. An angle between the second part 406 and the first part 404 is adjusted by altering a length of the strut 418. In this embodiment, the strut 418 comprises a lockable gas spring 418, which comprises a piston 418*a* and a piston body, or cylinder, 418*b* within which the piston 418*a* is movable. The interior of the cylinder 418*b* is divided into two portions by a sliding bulkhead attached to the piston 418*a*. A handle 410 is pivotally mounted on the second part 406 of the body 402, one end of a push link 412 is pivotally connected to the handle 410, and the other end of the push link 412 is connected to a nipple on the piston 418*a*. The connection of the handle 410 to the push link 412 is spaced on the handle 410 from the connection of the handle 410 to the second part 406. When the handle 410 is rotated, from its rest position shown in FIG. 4 and relative to the second part 406, the push link 412 is pushed against the nipple, which in turn fluidly connects the two portions of the interior of the cylinder 418*b* to permit relative movement of the piston 418*a* and the cylinder 418*b*, and thus to permit movement of the second part 406 relative to the first part 404 about the third axis A3 to place the second part 406 at a desired inclination relative to the first part 404. Subsequent movement of the handle 410 back to its rest position releases pressure of the push link 412 on the nipple, closing the gate between the two interior chambers of the cylinder 418*b*. This isolates one of the interior chambers of the cylinder 418*b* from the other, which in turn substantially prevents relative movement of the piston 418*a* and the cylinder 418*b*. Accordingly, the position of the second part 406 relative to the first part 404 is locked. The handle 410 may be biased to its rest position.

The support 400 further comprises a support element 420, which in this embodiment is fixed to the second part 406 of the body 402 by means of screws 420*a*. The support element 420 is made at least partially, and preferably wholly, from radio translucent material(s). This permits a patient's leg, supported on the support element 420, to be x-rayed without a significant shadow being created on the resultant image by the support element 420. Such material may comprise one or more of a carbon fiber reinforced polymer, polyoxybenzylmethylenglycolanhydride (or "Bakelite" (Registered Trademark) or filled phenolic resin). Indeed, many polymer-based materials should have good radio translucent properties.

In this embodiment the support element 420 is a planar plate. However, in other embodiments, the support element 420 may be a substantially non-planar plate or not plate-like at all. For example, the support element 420 may comprise one or more bars extending from the second part 406 in a direction that is non-parallel to a dimension of the second part 406 extending between the distal end of the second part 406 and the third pivot joint P3. The support element 420 need only be suitable to support a mattress 24 (not shown in FIG. 4, but shown in FIG. 1) upon which the leg of a patient is supportable. In some embodiments any other resilient element may be provided in place of the mattress 24. Preferably the resilient element 24 is detachably mountable on the support element 420 by a user, such as by a member of hospital staff. In contrast, it will be noted that the intermediate member 300 excludes a mattress or any other resilient element upon which a leg of a patient is supportable.

In any case, the support element 420 has a maximum width (W) in a first direction perpendicular to the second axis A2, and a maximum length (L) in a second direction that is perpendicular to the first direction and parallel to the third axis A3. Preferably the width (W) is between 20 and 35 cm. Preferably the length (L) is between 40 and 80 cm. In this embodiment, the width (W) is 27 cm and the length (L) is 69.5 cm. Preferably, a distance between the first axis A1 and the second axis A2 is less than the width (W) of the support element 420. More preferably, the distance between the first axis A1 and the second axis A2 is less than or equal to half the width (W) of the support element 420. The length (L) and width (W) of the support element 420 together define an imaginary rectangular area. The first and second axes A1, A2 both lie outside of the imaginary rectangular area. That is, neither of the first and second axes A1, A2 intersects the imaginary rectangular area. Indeed, each of the first and second pivot joints P1, P2 and the intermediate member 300 lies outside of the imaginary rectangular area. Moreover, the second part 406 is disposed only along one side of the support element 420, such that the second part 406 lies outside of the imaginary rectangular area. As a result, none of the second part 406, the first and second pivot joints P1, P2, and the intermediate member 300 would create a significant shadow, were the support element 420 to be x-rayed. When the second part 406 is minimally inclined, or is parallel, to the first part 404, the imaginary rectangular area is preferably normal to the second axis A2.

Accordingly, the articulated joint comprising the first and second pivot joints P1, P2 and the intermediate member 300 is disposed away from the support element 420 outside of the imaginary rectangular area, such that the components of the articulated joint, and the underside of the support element 420, are easily accessible for servicing and cleaning thereof, and such as to provide a region (corresponding to the area of the imaginary rectangle) of x-ray transparency. Moreover, since the articulated joint is disposed wholly between the connector 200 and the first body 404 of the support 400, and not in overlap with the support element 420, the articulated joint is compact. Thus, the articulated joint adds minimal weight to the leg support 20, which permits the leg support 20 to be lightweight while, at the same time, in use enables improved access to areas between a patient's legs.

The connector 200, intermediate member 300, support 400 and the pivot joints P1, P2 therebetween can be considered as comprised in a mechanical linkage or kinematic chain. The connector 200, intermediate member 300 and support 400 are respective rigid bodies, or links, of the chain and the first and second pivot joints P1, P2 are the connections, or joints, between the links of the chain.

In the illustrated embodiment, the mechanical linkage, or kinematic chain, is an open chain that consists of the following five elements, in order as a series: the connector 200, the first pivot joint P1, the intermediate member 300, the second pivot joint P2, and the support 400. That is, the chain consists of the connector 200, the intermediate member 300 and the support 400 as respective links and the first and second pivot joints P1, P2 as respective joints. The connector 200 may be considered a ground link, at least when the leg support 20 is mounted on the lower torso support 18 of the table 2. The linkage or chain of these five elements has (only) two degrees of freedom (i.e. rotation of the intermediate member 300 relative to the connector 200 about the first axis A1, and rotation of the support 400 relative to the intermediate member 300 about the second axis A2, independently of rotation of the intermediate member 300 relative to the connector 200), and these five elements are restricted to motion in only a single plane.

As discussed above, the support 400 has a body 402 that comprises two relatively-movable parts 404, 406 (although, as discussed below, it is not essential that the body 402 has these two relatively-movable parts). The above-described embodiment thus may be considered to define a mechanical linkage, or kinematic chain, that is an open chain consisting of the following seven elements, in order as a series: the connector 200, the first pivot joint P1, the intermediate member 300, the second pivot joint P2, the first part 404, the third pivot joint P3, and the second part 406. That is, the chain consists of the connector 200, the intermediate member 300, the first part 404 and the second part 406 as respective links and the first, second and third pivot joints P1, P2, P3 as respective joints. The linkage or chain of these seven elements has (only) three degrees of freedom (i.e. the two degrees of freedom discussed above, and also rotation of the second part 406 relative to the first part 404 about the third axis A3, independently of rotation of the intermediate member 300 relative to the connector 200 and independently of rotation of the first part 404 relative to the intermediate member 300). The seven elements are restricted to motion in only two planes, which preferably are non-parallel to each other.

Figure 5:
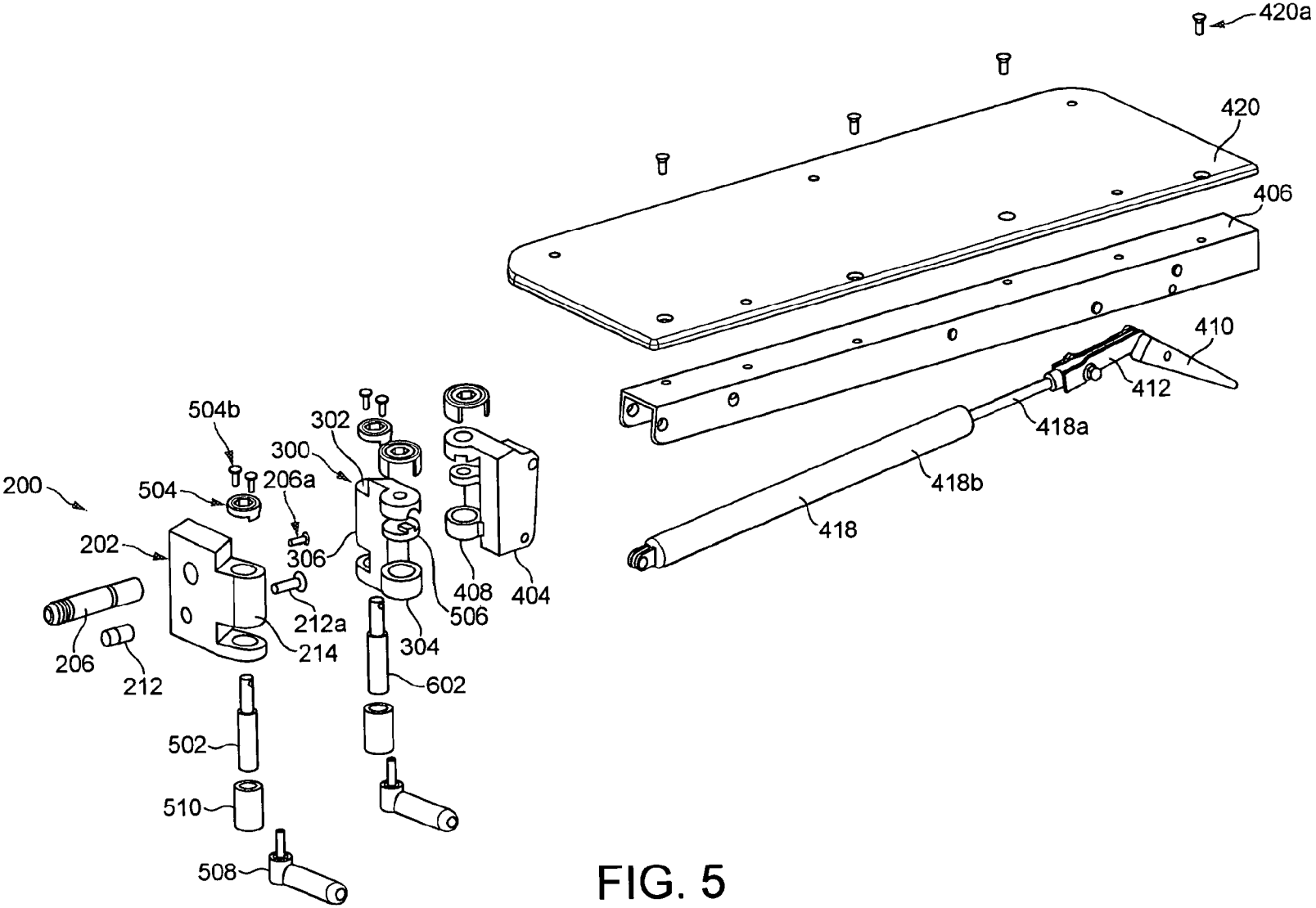
FIG. 5 is an exploded schematic view of the leg support of FIG. 4, with the cover, sidebar and mattress again omitted for clarity.
Figure 9:
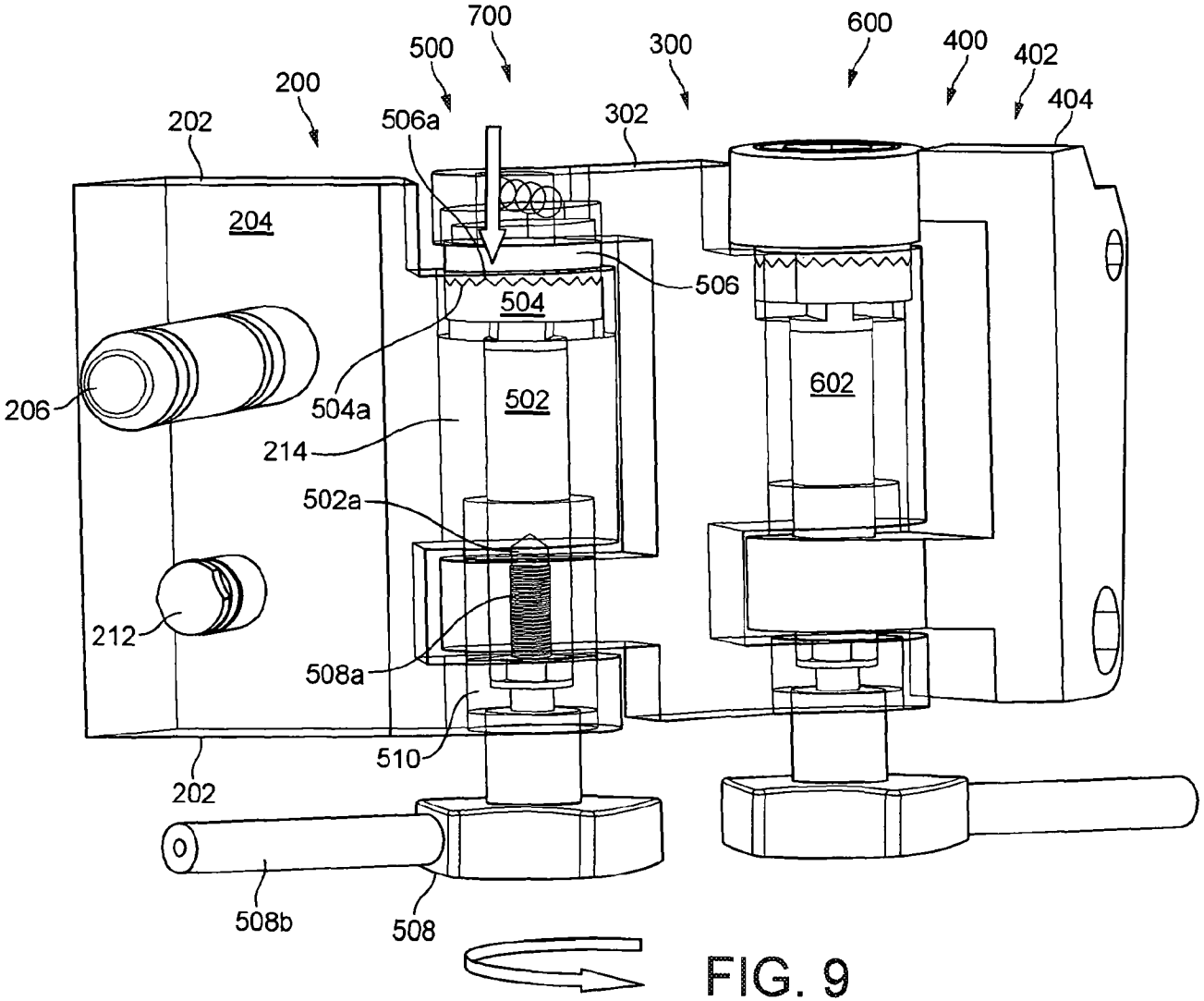
FIG. 9 is a schematic perspective view of a locking mechanism for the leg support of FIG. 4, with some components shown as being transparent for clarity.

The leg support 20 further has a lock mechanism 700 that comprises independently-operable first and second locks 500, 600, as shown in FIGS. 4, 5 and 9. The first lock 500 is operable to releasably fix the relative position of the intermediate member 300 and the connector 200, and the second lock 600 is operable to releasably fix the relative position of the support 400 and the intermediate member 300.

The first lock 500 comprises a first dog 504 that is fixed to the body 202 of the connector 200 by means of a pair of screws 504*b* so as to axially and rotationally fix the first dog 504 relative to the body 202. The first dog 504 is circular with the centre of the circle lying on the first axis A1. The first dog 504 is rotatable only with the body 202 about the first axis A1. The first dog 504 has a hole therein. The first pivot pin 502 is located in the hole and is movable along and about the first axis A1 relative to the first dog 504 and the body 202. The first dog 504 has an axial end facing the first pivot pin 502 and has a circumferential ring of teeth 504*a* projecting from an opposite second axial end thereof.

The first lock 500 further comprises a second dog 506 that is fixed to the body 302 of the intermediate member 300 so as to axially and rotationally fix the second dog 506 relative to the body 302 of the intermediate member 300. The pin 502 also is fixed relative to the body 302. The second dog 506 is rotatable only with the body 302 and the pin 502 about the first axis A1. The second dog 506 is circular with the centre of the circle lying on the first axis A1. The second dog 506 has a circumferential ring of teeth 506*a* on an axial end thereof, which ring of teeth 506*a* are coaxial with the ring of teeth 504*a* of the first dog 504.

A second, opposite end of the first pivot pin 502 has a threaded bore 502*a* therein, which bore 502*a* is aligned with the first axis A1. The first lock 500 further comprises a handle 508 comprising threaded shaft 508*a*, which is mated with the threaded bore 502*a* of the pin 502, and a lever 508*b*, which is rotationally fixed relative to the threaded shaft 508*a* and extends from the threaded shaft 508*a* in a radial direction from the first axis A1. Note that, in FIGS. 1 to 3*b*, the levers 508*b* of the handles 508 of the first and second locks 500, 600 are replaced by rotatable knobs. Either form of handle may be used. A collar 510 is disposed between the handle 508 and the barrel 214 of the body 202 of the connector 200, the collar 510 serving to prevent axial movement of the handle 508 relative to the body 202 and relative to the pin 502. Part of the pin 502 is disposed in the collar 510 and the pin 502 is axially moveable relative to the collar 510. Although FIG. 9 shows a nut within the collar 510, this nut may be omitted.

In order to lock the position of the intermediate member 300 relative to the connector 200 (as shown in FIG. 9), a user grasps the lever 508*b* and uses it to rotate the handle 508 about the first axis A1 relative to the collar 510 and relative to the pin 502. This causes rotation of the threaded shaft 508*a* relative to the collar 510 and relative to the pin 502, which thus causes the pin 502 to be pulled further into the collar 510. Since the pin 502 and the second dog 506 are fixed to the body 302 of the intermediate member 300, this action causes the second dog 506 to be pulled towards the first dog 504, thus engaging the teeth 504*a*, 506*a* of the dogs 504, 506. Since the first dog 504 is rotationally fixed relative to the body 202 and the second dog 506 is rotationally fixed relative to the body 302, once the teeth 504*a*, 506*a* are engaged the bodies 202, 302 are rotationally fixed relative to one another. As such, the position of the intermediate member 300 is fixed relative to the connector 200.

In order to unlock the first lock 500, the handle 508 is rotated in the opposite direction, which creates slack in the assembly. The intermediate member 300 (with the pin 502 and second dog 506) may then be lifted by hand relative to the connector 200, which causes the teeth 504*a*, 506*a* of the dogs 504, 506 to disengage. Movement of the intermediate member 300 about the first axis A1 relative to the connector 200 is then permitted and, once the user has selected roughly a desired position of the intermediate member 300 relative to the connector 200 about the axis A1, the intermediate member 300 can be lowered to cause the teeth 504*a*, 506*a* of the dogs 504, 506 to reengage. The sets of teeth 504*a*, 506*a* each have a pitch (of 15°) in this embodiment) so, as the teeth 504*a*, 506*a* reengage, the intermediate member 300 is forced to adopt one of a plurality of available predetermined index angles relative to the connector 200. Once the teeth 504*a*, 506*a* are fully engaged, the first lock 500 may then be locked to axially lock the teeth 504, 506*a* relative to one another, as discussed above.

The second lock 600 is operable in the same way as the first lock 500 so, in the interests of conciseness, a detailed discussion thereof will not be given. In short, the support 400 is releasably lockable at one of a plurality of available predetermined index angles relative to the intermediate member 300, the selected index angle being independent of the position of the intermediate member 300 relative to the connector 200.

Figure 10:
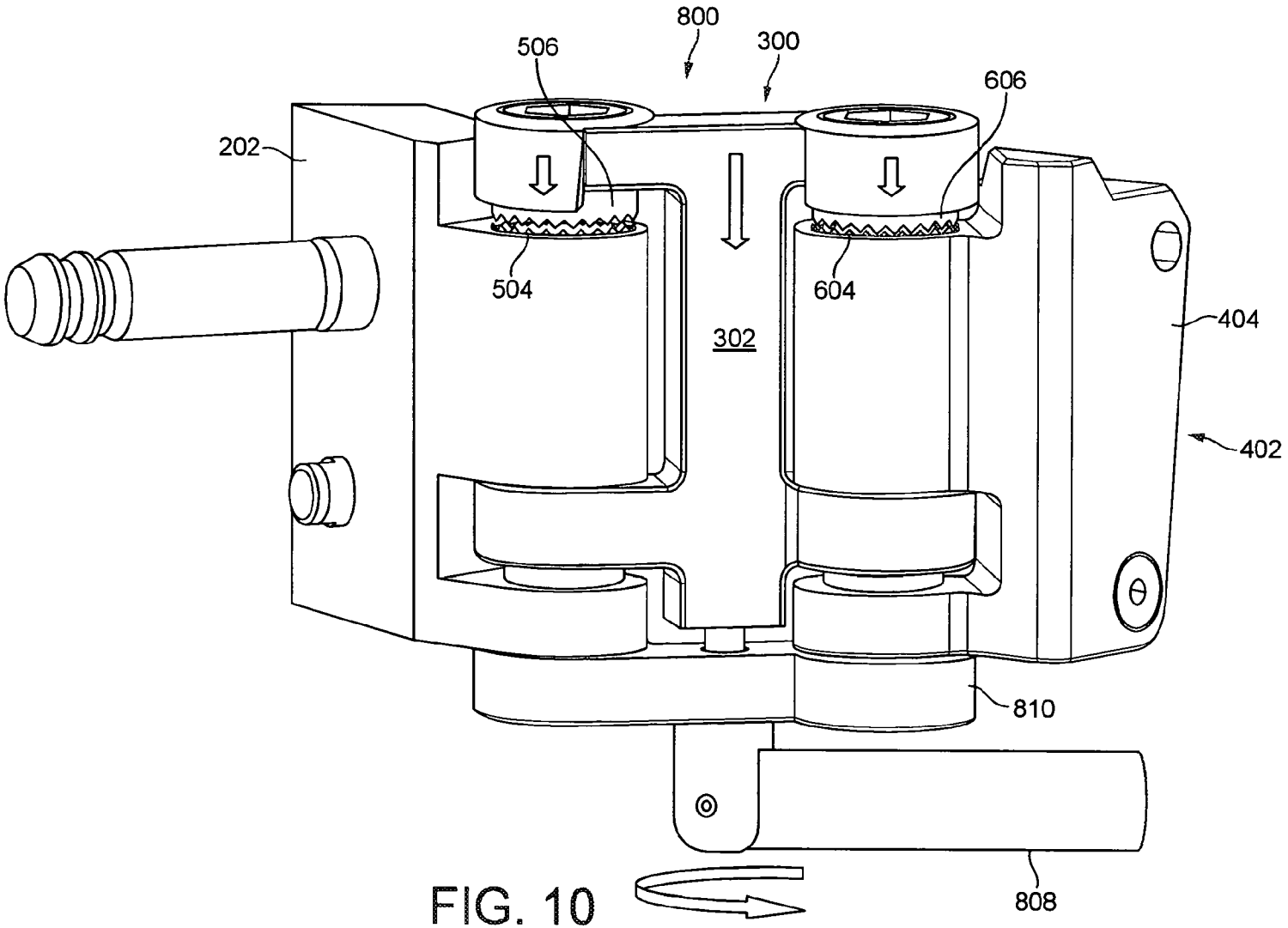
FIG. 10 is a schematic perspective view of an alternative locking mechanism for the leg support of FIG. 4.

An alternative lock mechanism 800 for use in the illustrated embodiment is shown in FIG. 10. This alternative lock mechanism is operable through only a single action, i.e. rotation of the handle 808, to releasably fix both the relative position of the intermediate member 300 and the connector 200 and the relative position of the support 400 and the intermediate member 300. The alternative lock mechanism 800 is effectively a combination of the first and second locks 500, 600 discussed above except that, instead of having a pair of handles 508 with respective threaded shafts 508*a* that mate directly with respective threaded bores 502*a* in the pivot pins 502, 602, in the alternative lock mechanism 800 there is only one rotatable handle 808, which has a threaded shaft (not shown) that mates with a threaded bore (not shown) formed in the body 302 of the intermediate member 300. A movable bar 810 is provided, through a hole of which the shaft of the handle 508 extends. The bar 810 has pegs (not shown) extending therefrom, which pegs are fixed to the pivot pins 502, 602. Rotation of the handle 808 in one direction (as indicated by the arrow in FIG. 10) causes the bar 810 and the body 302 of the intermediate member 300 to be moved towards each other. This causes the pivot pins 502, 602 and the respective second dogs 506, 606, which are fixed relative to the body 302, to move towards the bar 810, which in turn causes the teeth of the respective second dogs 506, 606 to engage the teeth of respective first dogs 504, 604, which are fixed relative to the bodies 202, 402 of the connector 200 and the support 400, respectively. Once the teeth are engaged the bodies 202, 302 and 302, 402 are rotationally fixed relative to one another. As such, the position of the intermediate member 300 is fixed relative to the connector 200 and relative to the support 400. Again, the intermediate member 300 is releasably lockable at one of a plurality of available predetermined index angles relative to the connector 200, and the support 400 is releasably lockable at one of a plurality of available predetermined index angles relative to the intermediate member 300, the selected index angle being independent of the position of the intermediate member 300 relative to the connector 200.

It will be appreciated that the above-described leg support 20 may be provided in the form of a kit of parts, with the intermediate member 300 being mountable on the connector 200 by the first pivot joint P1, and the support 400 being mountable on the intermediate member 300 by the second pivot joint P2, such that a plane normal to the second axis A2 passes through both the intermediate member 300 and the support 400.

A method of configuring a surgical table 2, including configuring the above-described leg support 20, will now be described with reference primarily to FIGS. 6 to 8*d*. It is assumed that, although not shown, the mattress 24 is present on the support element 420.

Figure 6:
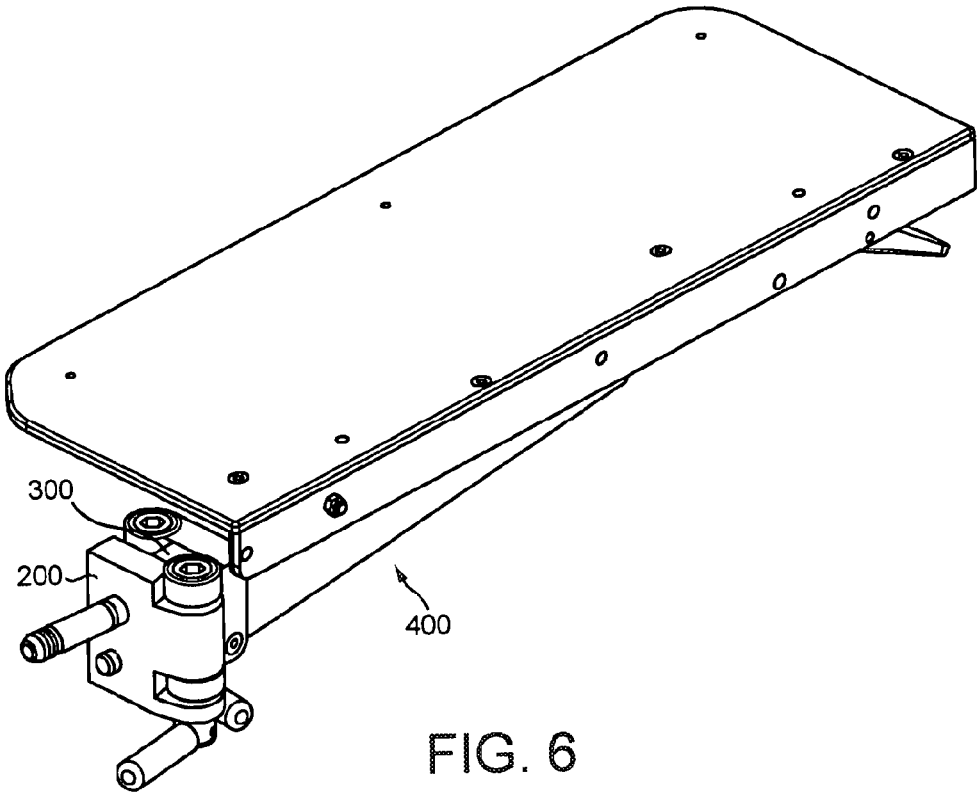
FIG. 6 is a schematic perspective view of the leg support of FIG. 4, shown with its articulated joint in a first state, with the cover, sidebar and mattress again omitted for clarity.
Figure 7:
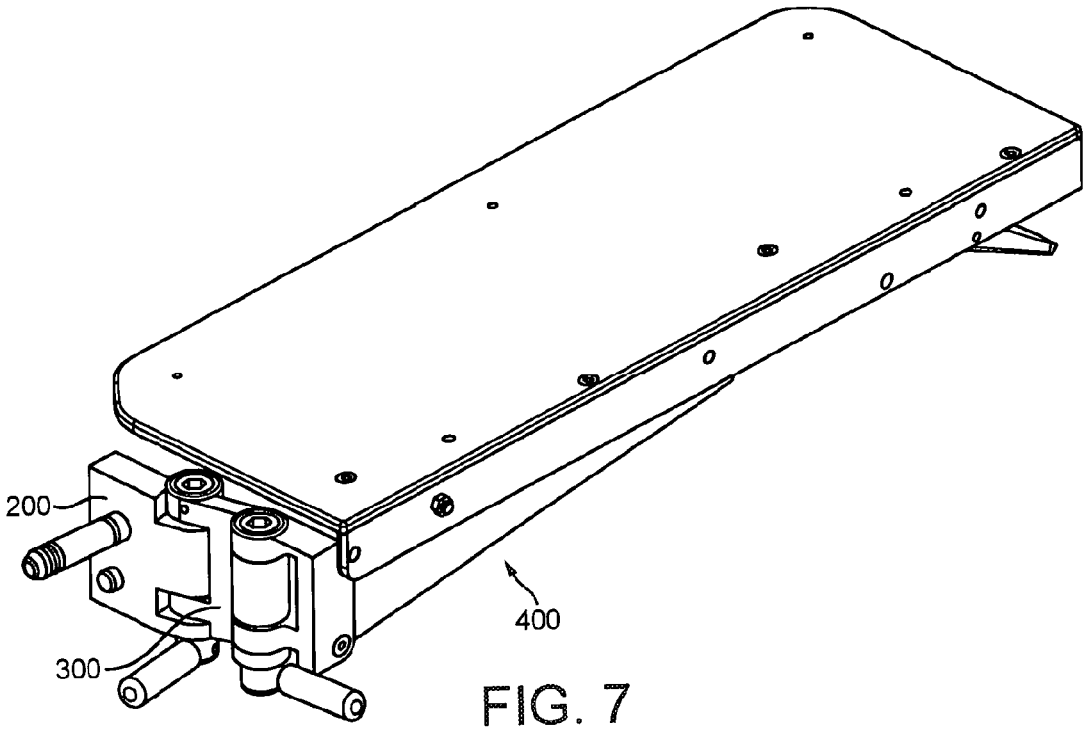
FIG. 7 is a schematic perspective view of the leg support of FIG. 4, shown with its articulated joint in a second state, with the cover, sidebar and mattress again omitted for clarity.
Figure 8A:
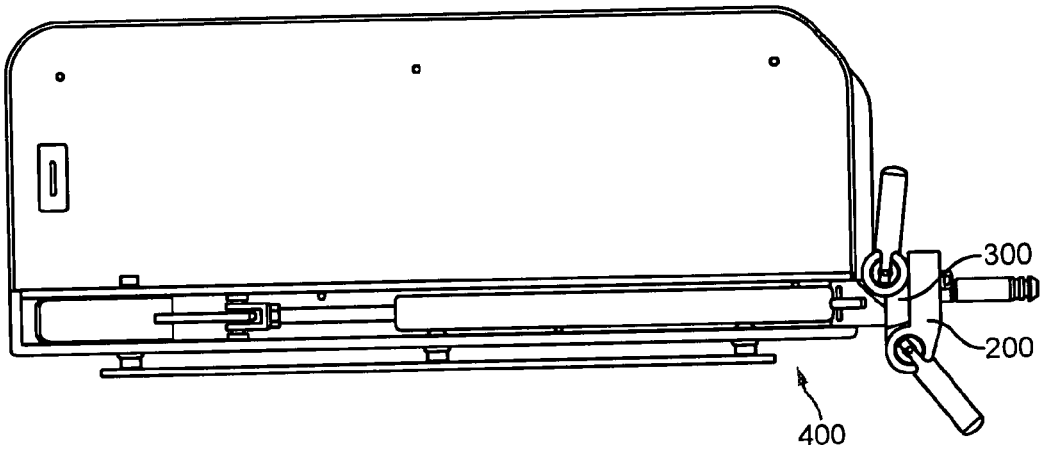
FIGS. 8*a* to 8*d* are schematic views of the underside of the leg support of FIG. 4 showing, respectively, the arrangement of the leg support at various points during its transition from the first state shown in FIG. 6 to the second state shown in FIG. 7, with the cover, sidebar and mattress again omitted for clarity.

The connector 200 of the leg support 20 is detachably connected to the lower torso support 18 of the surgical table 2 of FIG. 1, in the manner described above At this time, the articulated joint is preferably in a first state, with the relative positions of the connector 200, the intermediate member 300, and the support 400 being as shown in FIGS. 6 and 8*a*. That is, the body 302 of the intermediate member 300 is abutting the body 202 of the connector 200, such that the intermediate member 300 is at a first limit of its possible range of travel relative to the connector 200. Also, the body 402 of the support 400 is abutting the body 302 of the intermediate member 300, such that the support 400 is at a first limit of its possible range of travel relative to the intermediate member 300 Although, for clarity, these Figures do not show the position of the leg support 20 relative to the rest of the table 2, the relative position of the connector 200 and the lower torso support 18 is as shown in FIG. 1 and remains so while the leg support 20 is connected to the lower torso support 18 by the connector 200.

If locked, the first and second locks 500, 600 are unlocked, as described above with reference to FIG. 9.

Figure 8B:
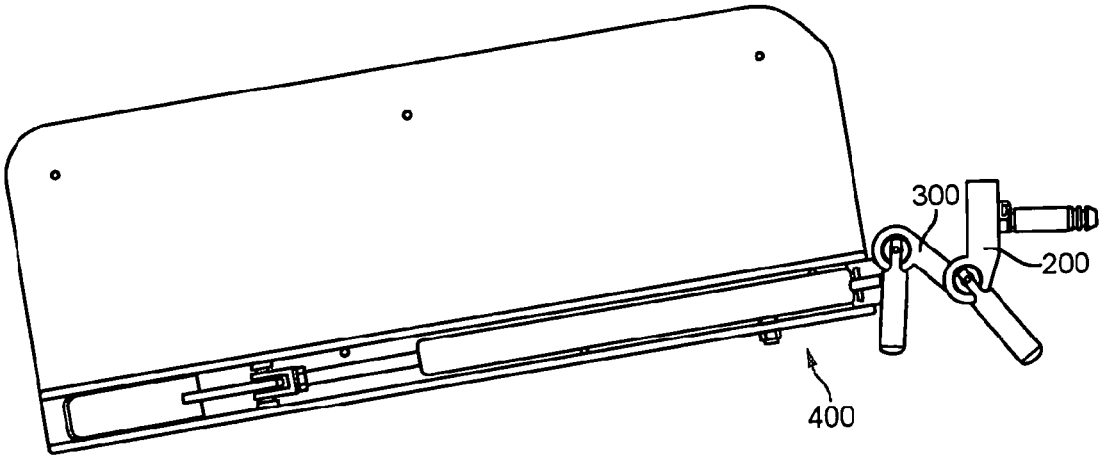

The intermediate member 300 is then displaced relative to the connector 200 about the first axis A1, and the support 400 is independently displaced relative to the intermediate member 300 about the second axis A2, to reach the position shown in FIG. 8*b*.

Figure 8C:
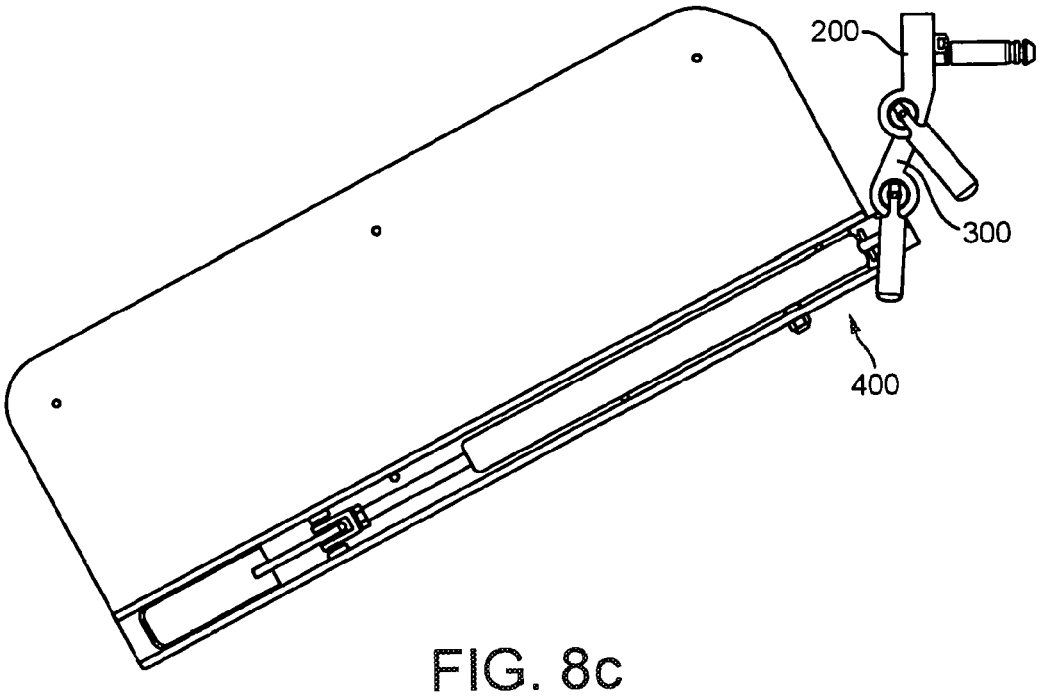
Figure 8D:
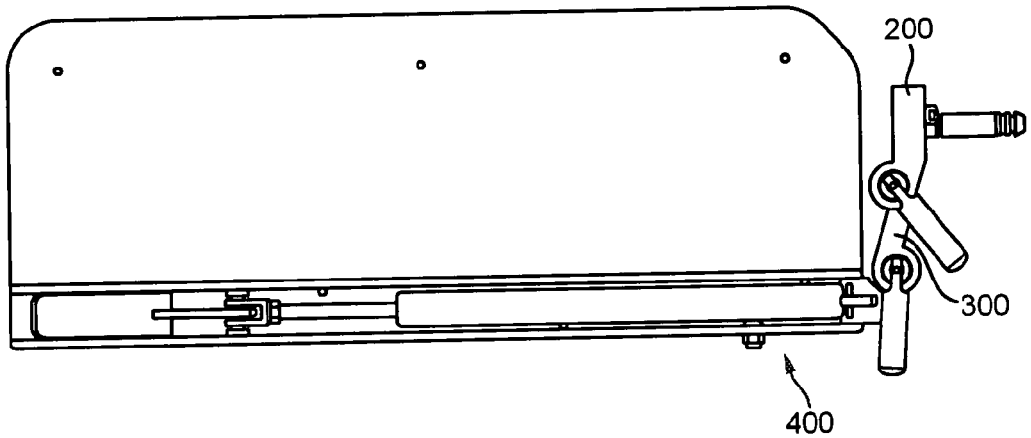

Displacement of the intermediate member 300 relative to the connector 200, and the independent displacement of the support 400 relative to the intermediate member 300, is continued until the position shown in FIG. 8*c* is reached. Here, the intermediate member 300 has been displaced to the second limit of its possible range of travel relative to the connector 200, which second limit is at the opposite end of the range of travel from the first limit. The range of travel in this embodiment is approximately 165 degrees.

Optionally, the first lock 500 may now be actuated by a user to lock the position of the intermediate member 300 relative to the connector 200 at the position shown in FIG. 8*c*.

Displacement of the support 400 relative to the intermediate member 300 is continued until the position shown in FIGS. 7 and 8*d* is reached and the articulated joint is in a second state. Here, the intermediate member 300 and the connector 200 are relatively positioned as in FIG. 8*c*, but the support 400 has been displaced to the second limit of its possible range of travel relative to the intermediate member 300, which second limit is at the opposite end of the range of travel from the first limit. The range of travel in this embodiment is approximately 165 degrees.

The second lock 600 may now be actuated by a user to lock the position of the support 400 relative to the intermediate member 300 at the position shown in FIGS. 7 and 8*d*. Also, if not already performed, the first lock 500 may now be actuated by a user to lock the position of the intermediate member 300 relative to the connector 200 at the position shown in FIGS. 7 and 8*d*, which is the same as their relative position in FIG. 8*c*.

Although in the described method there is independent displacement of the intermediate member 300 relative to both the connector 200 and the support 400, in other embodiments the intermediate member 300 may be displaced relative to only one of the connector 200 and the support 400.

Naturally, a second leg support 20*b* that is identical to the above-described leg support 20, other than being a mirror-image thereof, also is detachably connected to the lower torso support 18 of the surgical table 2 of FIG. 1, in the manner described above, and may be configured in the same or a similar way to that described above.

Of course, one leg support 20 is manipulatable independently of the other leg support 20*b*, and the components of one of the leg supports 20, 20*b* need not be positioned and locked in the same state as components of the other of the leg supports 20, 20*b*.

If both leg supports 20, 20*b* are connected to the lower torso support 18 and placed in the state shown in FIGS. 6 and 8*a*, then the support elements 24 and associated mattresses 24 of the leg supports 20, 20*b* will lie with their respective lengths parallel to each other. If both leg supports 20, 20*b* are connected to the lower torso support 18 and placed in the state shown in FIGS. 7 and 8*d*, then the support elements 24 and associated mattresses 24 of the leg supports 20, 20*b* will again lie with their respective lengths parallel to each other but, in this case, the support elements 24 and associated mattresses 24 will be further spaced apart than in the state of FIGS. 6 and 8*a*.

If both leg supports 20, 20*b* are connected to the lower torso support 18 and placed and locked in the state shown in FIG. 8*c*, then the support elements 24 and associated mattresses 24 of the leg supports 20, 20*b* will lie with their respective lengths non-parallel to each other and further apart at the distal end of the second part 406 than at a position closer to the second pivot joint P2.

With a leg support 20 in the position shown in FIG. 8*c*, a patient's leg may be lowered onto the mattress 24 of the leg support 20 at a position at which the leg is abducted from the median plane of the rest of the patient's body, to aid a doctor or surgeon in accessing areas between the patient's legs.

With the intermediate member 300 at any position relative to the connector 200 and at any position relative to the support 400, the second part 406 of the support body 402 may be displaced relative to the first part 404 of the support body 402 about the third axis A3 in order to configure the mattress 24 as an inclined surface for receiving a patient's leg.

The leg supports 20 may be returned to the more compact position shown in FIGS. 6 and 8*a* by unlocking the locks 500, 600, moving the support 400 back to its first limit of its range of travel relative to the intermediate member 300, and moving the intermediate member 300 back to its first limit of its range of travel relative to the connector 200.

While the above method involves independently locking and unlocking independent first and second locks 500, 600, it will of course be appreciated that the first and second locks 500, 600 may be replaced by the alternative lock mechanism 800 described above with reference to FIG. 10, in order to fix/release both the relative position of the intermediate member 300 and the connector 200 and the relative position of the support 400 and the intermediate member 300.

It will thus be appreciated that the provision of the articulated joint (i.e. the combination of the first and second pivot joints P1, P2 and the intermediate member 300) connecting the support 400 to the connector 200 enables the support 400 and associated mattress 24 to be moved further from its compact rest position (shown in FIGS. 6 and 8*a*) than would be possible in an equivalent mechanism in which the intermediate member 300 and one of the pivot joints P1, P2 is omitted. Also, the number of possible different relative positions of the support 400 and the connector 200 is much greater in embodiments of the present invention, since the provision of the two pivot joints P1, P2 gives an additional degree of freedom. Thus, with a patient's legs disposed on the leg supports 20, 20*b* and the leg supports 20, 20*b* separated from each other, e.g. as shown in e.g. FIGS. 8*c* and 8*d*, a surgeon is better able to access areas between the patient's legs.

It will also be appreciated that the number of moving parts of the leg support 20 is minimal, while still providing improved access to areas between the patient's legs. As such, maintenance, and possible failure, of the leg support 20 may be minimized.

Various modifications can be made to the above-described embodiments without departing from the scope of the present invention.

For example, although the above-described leg supports 20 are disconnectable and detachable from the lower torso support 18 of the rest of the table 2, in an alternative embodiment one or both of the leg supports 20 may be fixed to the rest of the surgical table 2, and may not be disconnectable from the lower torso support 18, at least by a user of the table 2.

In other embodiments where the leg support is detachably connectable to a table, the means by which the connector is connectable to the table may differ from the arrangement discussed above. For example, the anti-rotation projection could be omitted and the tubular member of the lock projection could be of a non-circular cross section to prevent rotation of the body of the connector relative to the lower torso support about the longitudinal axis of the tubular member.

In contrast to the above-described embodiment, in an alternative embodiment the support body 402 may not comprise two parts 404, 406 connected together by the third pivot joint P3. That is, the third pivot joint P3 may be omitted and the above-described parts 404, 406 may be immovable relative to one another or integrally formed with one another as a single body part. Accordingly, in such an alternative embodiment, the support 400 would comprise a body 202 and the support element 420, of any one of the forms described above, would be fixed to the body 402 by means of screws 420*a* or otherwise. Moreover, in such an embodiment, preferably the imaginary rectangular area is normal to the second axis A2 and preferably the body 402, the first and second pivot joints P1, P2 and the intermediate member 300 lie outside of the imaginary rectangular area, similarly to the manner discussed above.

In contrast to the above-described embodiment, in an alternative embodiment the various cooperating dogs (e.g. 504, 506) do not have teeth. Rather, each of the dogs (e.g. dog 540) has a substantially smooth (or slightly roughened) surface that is able to frictionally engage a similar surface of a cooperating dog (e.g. dog 506). As such, the positions at which the intermediate member 300 may be locked relative to the connector 200 and relative to the support 400 are not predetermined according to the pitch of any teeth, but rather the intermediate member 300 may be locked at any angle relative to the connector 200 and at any angle relative to the support 400.

Also, the first and second pivot joints P1, P2 may take a different form to the barrel hinges described above. For example, the intermediate member 300 and the connector 200 may both be rotationally movable relative to the first pivot pin 502, and/or the intermediate member 300 and the support 400 may both be rotationally movable relative to the second pivot pin 602. Other forms of pivot joints P1, P2 could be employed. However, in order to keep the leg support 20 of simple, lightweight construction, it remains preferable that the intermediate member 300 be displaceable relative to the connector 200 only about the first axis A1, and similarly it remains preferable that the support 400 be displaceable relative to the intermediate member 300 only about the second axis A2.

Still further, the lock mechanism could take any suitable form other than the mechanisms 700, 800 discussed above. It is preferable that the position of the intermediate member 300 relative to each of the connector 200 and the support 400 be lockable. However, in some embodiments, no lock may be provided between the intermediate member 300 and one or both of the connector 200 and the support 400.

Still further, the leg support 20, 20*b* may include an on-board power supply, such as a tank of compressed or pressurised gas or liquid, a cell or battery, or a connector to which such an on-board power supply may be fitted. Such an on-board power supply or connector may be fluidly or electrically, as appropriate, connected to the strut as an energy supply for powering the strut to alter inclination of the second part 406 relative to the first part 404 of the support body 402.

Alternatively, or additionally, one or other of the tubular member 208 and the anti-rotation pin 212 may comprise a conduit for carrying an energy supply for the actuator 418. For example, the conduit may comprise a pipe or channel fluidly connected to the actuator 418 and through which may be conveyed a gas or liquid to the actuator. Alternatively, the conduit may comprise one or more electrically-conductive wires electrically connected to the actuator 418.

What is claimed is:

1. A leg support for a surgical table, the leg support comprising:

a connector for connecting the leg support to a surgical table;

an intermediate member mounted on the connector by a first pivot joint defining a first axis about which the intermediate member is displaceable relative to the connector and the intermediate member is displaceable relative to the connector only about the first axis; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support.

2. The leg support of claim 1, wherein the support is displaceable relative to the intermediate member only about the second axis.

3. The leg support of claim 1, wherein the support is displaceable relative to the connector only by one or both of displacement of the intermediate member relative to the connector about the first axis and displacement of the support relative to the intermediate member about the second axis.

4. The leg support of claim 1, wherein the support is displaceable relative to the intermediate member about the second axis between a position at which a body of the support abuts a body of the intermediate member and a position at which the body of the support does not abut the body of the intermediate member.

5. The leg support of claim 1, wherein the support is displaceable relative to the intermediate member about the second axis over an angle of at least 135 degrees, optionally over an angle of at least 150 degrees, and further optionally over an angle of at least 165 degrees, and/or wherein the intermediate member is displaceable relative to the connector about the first axis over an angle of at least 135 degrees, optionally over an angle of at least 150 degrees, and further optionally over an angle of at least 165 degrees.

6. The leg support of claim 1, wherein a plane normal to the first axis passes through both the intermediate member and the connector, optionally wherein the plane normal to the first axis is coplanar with the plane normal to the second axis.

7. The leg support of claim 1, wherein the intermediate member is displaceable relative to the connector about the first axis between a position at which a body of the intermediate member abuts a body of the connector and a position at which the body of the intermediate member does not abut the body of the connector.

8. The leg support of claim 1, comprising a lock mechanism operable to fix one or both of the relative position of the intermediate member and the connector and the relative position of the support and the intermediate member, optionally wherein the lock mechanism is operable through only a single action to fix both the relative position of the intermediate member and the connector and the relative position of the support and the intermediate member.

9. The leg support of claim 1, wherein the support comprises a resilient element upon which the leg of a patient is supportable, optionally wherein the resilient element is detachably connected to the support.

10. The leg support of claim 1, wherein the support comprises a body that has a first part mounted on the intermediate member by the second pivot joint and displaceable relative to the intermediate member about the second axis, and a second part that is mounted on the first part by a third pivot joint defining a third axis about which the second part is displaceable relative to the first part, optionally wherein the third axis is non-parallel to the second axis, further optionally wherein the third axis is perpendicular to the second axis.

11. The leg support of claim 1, wherein a distance between the first axis and the second axis is less than 20 cm, optionally less than 10 cm, further optionally between 5 cm and 10 cm, and further optionally between 5 cm and 8 cm.

12. The leg support of claim 1, wherein the support comprises a support element having a width in a first direction perpendicular to the second axis and a length in a second direction that is perpendicular to the first direction, wherein the width and length of the support element together define an imaginary rectangular area that is not intersected by either of the first and second axes, optionally wherein the support element is formed at least partially, and preferably wholly, of radio translucent material.

13. The leg support of claim 1, wherein the support comprises a support element having a width in a first direction perpendicular to the second axis and a length in a second direction that is perpendicular to the first direction, wherein a distance between the first and second axes is less than the width of the support element, optionally wherein the distance between the first and second axes is less than or equal to half the width of the support element.

14. The leg support of claim 1, wherein the intermediate member excludes any resilient element upon which the leg of a patient is supportable.

15. The leg support of claim 1, comprising an open chain consisting of, in order: the connector, the first pivot joint, the intermediate member, the second pivot joint, and the support, optionally wherein the open chain has only two degrees of freedom and/or optionally wherein the chain is restricted to motion in only a single plane.

16. The leg support of claim 1, wherein the support comprises a body that has a first part mounted on the intermediate member by the second pivot joint and displaceable relative to the intermediate member about the second axis, and a second part that is mounted on the first part by a third pivot joint defining a third axis about which the second part is displaceable relative to the first part, and wherein the leg support comprises an open chain consisting of, in order: the connector, the first pivot joint, the intermediate member, the second pivot joint, the first part, the third pivot joint, and the second part, optionally wherein the open chain has only three degrees of freedom and/or optionally wherein the chain is restricted to motion in only two planes.

17. A kit of parts for a leg support for a surgical table, the kit of parts comprising:

a connector for connecting the leg support to a surgical table;

an intermediate member mountable on the connector by a first pivot joint defining a first axis about which the intermediate member is displaceable relative to the connector and the intermediate member is displaceable relative to the connector only about the first axis; and a support for supporting a leg of a patient, the support mountable on the intermediate member by a second pivot joint defining a second axis about which the support is displaceable relative to the intermediate member independently of displacement of the intermediate member relative to the connector about the first axis, the second axis being parallel to the first axis, wherein the support is mountable on the intermediate member by the second pivot joint such that a plane normal to the second axis passes through both the intermediate member and the support.

18. A surgical table comprising a tabletop providing a patient support surface, the tabletop having a head support, a torso support and a leg support section arranged respectively in that order along a longitudinal direction of the tabletop between upper and lower ends of the tabletop, the leg support section having a leg support comprising:

a connector by which the leg support is connected to the torso support;

an intermediate member mounted on the connector by a first pivot joint defining a first axis about which the intermediate member is displaceable relative to the connector and the intermediate member is displaceable relative to the connector only about the first axis; and a support for supporting a leg of a patient, the support mounted on the intermediate member by a second pivot joint defining a second axis about which the support is displaceable relative to the intermediate member independently of displacement of the intermediate member relative to the connector about the first axis, the second axis being parallel to the first axis, and a plane normal to the second axis passing through both the intermediate member and the support.

19. The surgical table of claim 18, wherein the leg support section comprises a pair of leg supports disposed beside each other in a transverse direction of the table.

* * * * *